United States Patent [19]

Koros et al.

[11] 3,982,969

[45] Sept. 28, 1976

[54] LOW SILICON HIGH STRENGTH LOW ALLOY STEEL

[75] Inventors: Peter J. Koros, Pittsburgh; John David Grozier, Bethel Park, both of Pa.

[73] Assignee: Jones & Laughlin Steel Corporation, Pittsburgh, Pa.

[22] Filed: Oct. 2, 1975

[21] Appl. No.: 619,099

[52] U.S. Cl. ..... 148/12 F; 75/123 E; 148/36

[51] Int. Cl.[2] ..... C21D 7/14; C22C 38/06; C22C 38/12

[58] Field of Search ..... 148/12 F, 36; 75/123 E

[56] References Cited

UNITED STATES PATENTS 3,666,452 5/1972 Korchynsky et al. ..... 148/12 F 3,926,686 12/1975 Creswick et al. ..... 148/12 F

*Primary Examiner*—W. Stallard

*Attorney, Agent, or Firm*—Gerald K. White; T. A. Zalenski

[57] ABSTRACT

The incidence of rare earth oxy-sulfide inclusions in killed hot-rolled high strength low alloy steels of the vanadium-nitrogen type is lowered through restriction of the silicon content to 0.05% maximum without a concurrent reduction of yield strength to values below 80,000 p.s.i. through a balance of composition, product thickness and hot-rolling collection temperature.

9 Claims, No Drawings

LOW SILICON HIGH STRENGTH LOW ALLOY STEEL

This invention relates to the field of high strength low alloy steels of the vanadium-nitrogen type that have been treated with rare earth materials for purposes of sulfide shape control. Such steels are typically subjected to controlled thermo-mechanical processing to attain a commercially attractive combination of mechanical properties in the hot-rolled metallurgical condition. Vanadium-nitrogen type high strength low alloy hot-rolled steels with sulfide shape control are capable of being routinely produced to obtain minimum ultimate and yield strengths of 95,000 and 80,000 p.s.i., respectively and minimum ductilities of 18% elongation (2 inches). Steel products of the above type are described in greater detail in U.S. Pat. No. 3,666,452. Our invention is an improvement to the invention described in the aforesaid patent.

A problem in the production of rare earth treated vanadium-nitrogen type steels is the formation of rare earth oxy-sulfide inclusions during ingot casting. These inclusions occur near the edges of the ingot and, upon subsequent hot-rolling, appear as defective areas near the edge of the resultant slab and/or strip. While this problem can be minimized through certain rare earth addition and casting techniques such as described in co-pending application Ser. No. 522,391, filed Nov. 11, 1974, this invention approaches the problem in a different manner.

It is believed that the inclusion formation mechanism appears to be associated with the presence of silicon, both alloyed in the steel as well as from rare earth silicon alloy additions when this type addition is employed. It may be that silicon from either or both sources becomes oxidized and is wetted by the liquid steel and thereby serves to prevent flotation of rare earth complexes such as rare earth oxy-sulfides.

Regardless of the correctness of the above-proposed mechanism, it has been discovered that if the silicon content of rare earth treated vanadium-nitrogen type steels is restricted to 0.05% maximum, the appearance of rare earth sub-surface complexes is virtually prevented. Consequently, silicon should not be added either in the form of an alloying element or as a component of rare earth additives. Thus, the very low silicon contents of the inventions are considered to be residual and occur primarily due to unavoidable pick-up from refractories, slag, etc. Unfortunately, silicon functions to increase ultimate and yield strengths in vanadium-nitrogen type steels by approximately 1,000 p.s.i. per 0.1% of silicon content. In this regard see J. D. Grozier and J. H. Bucher, *Correlation of Fatigue Limit with Microstructure and Composition of Ferrite-Pearlite Steels*, *Journal of Materials*, Volume 2, No. 2, June 1967. As vanadium-nitrogen steels are produced with a 0.60% maximum silicon and usually are commercially prepared at about 0.3% to 0.4% silicon, the ability to achieve routinely a yield strength of 80,000 p.s.i. minimum by the thermo-mechanical processing technique described in U.S. Pat. No. 3,666,452 is impaired when a 0.05% maximum silicon content is imposed. To compensate for the loss of strength due to the significantly lower silicon content of the steel of the invention, it has been found to be necessary to focus upon the interaction of chemical composition, product thickness and collection temperature to an extent that such factors are controlled within limits that will routinely lead to the achievement of an 80,000 p.s.i. minimum yield strength despite the virtual absence of silicon in the low alloy steel.

Accordingly, it is an objective of the invention to produce a sulfide-shape controlled, hot-rolled high strength low alloy steel of the vanadium-nitrogen type that possesses an 80,000 p.s.i. minimum yield strength and is characterized by being substantially free of macroscopic rare earth oxy-sulfide inclusions.

It is an additional objective of the invention to provide a process that is capable of producing routinely the desired mechanical properties of the invention.

These and other objectives and advantages of the invention will become apparent from the following description thereof.

To achieve the objectives of the invention, the following general chemical composition is required: carbon, 0.09% to 0.22%; manganese, 1.65% maximum; silicon, 0.05% maximum; sulfur, 0.025% maximum; nitrogen, 0.015% to 0.031%, vanadium, 0.10% to 0.14%; rare earth or rare earth mixture, 0.01% to 0.10%; aluminum, 0.01% to 0.09% balance essentially iron.

Carbon is maintained between 0.09% and 0.22% for strengthening purposes. When other strengthening elements are present at relatively low values, the carbon content should be restricted between 0.13% and 0.22% to ensure that an 80,000 p.s.i. yield strength is achieved in the hot-rolled condition. If the carbon content falls below 0.13%, the pearlite content of the steel is descreased to the point where it is no longer a sufficiently effective strengthening constituent. If the carbon content rises above 0.22%, it becomes difficult to weld the steel without forming low temperature transformation products in the weld heat affected zone and thus cold cracking can occur. With carbon above 0.22%, the steel must be preheated to prevent cold cracking from occuring during cooling after welding. Such procedure is oftentimes undesirable and unwieldy from the standpoint of the fabricator.

Manganese also promotes product strength and may be present in amounts up to 1.65%. Manganese contents appreciably greater than 1.65% should not be utilized because the cooling rate of the thermo-mechanical processing sequence—i.e., about 20°F to 135°F per second, will lead to excessive amounts of bainite and a decrease in toughness in the event that the manganese upper limit is exceeded. A lower limit of about 1.10% manganese is preferred for purposes of strengthening but lower amounts may be utilized as long as other strengthening elements are present in sufficient quantities.

Silicon should be restricted to no more than about 0.05% because this compositional restriction virtually prevents the formation of rare earth sub-surface complexes such as rare earth oxy-sulfides and thereby increases product yield. It is preferred to restrict silicon to 0.03% maximum to further ensure oxy-sulfide control for purposes of reliability and process control during steelmaking. Rare earth complexes form near the ingot edges during solidification and subsequently appear proximate to the edges of slabs and/or hot-rolled strip or plate upon hot working. Their presence requires excessive edge trimming of the product and a consequent yield loss. Yield improvements on the order of 2 to 6% are typically achieved by practice of the invention and represent a significant economic benefit on an annual basis. However, the silicon content limitation imposes a strength reduction penalty upon the steel of the invention as approximately each 0.1% silicon serves to increase yield strength by about 1,000 p.s.i.

The sulfur content of the steel of the invention should be 0.025% maximum. Higher quantities of sulfur require a correspondingly greater amount of rare earths to effect sulfide shape control and thereby render the product unnecessarily costly. On the other hand, a 0.025% maximum sulfur content is compatible with rare earth additions at a level of between 0.01% and 0.10%. This point is underscored when it is considered that relatively costly mischmetal additions must be utilized instead of less costly rare earth silicide addition agents.

Vanadium combines with nitrogen to form a fine, dispersed precipitate during cooling from the finishing temperature and also during collection of the hot rolled product. While the precipitates are believed to consist primarily of vanadium nitride, a lesser amount of complex vanadium carbo-nitrides are also believed to form. To achieve the 80,000 p.s.i. minimum yield strength objective, vanadium must be present in amounts ranging from 0.10% to 0.14% and nitrogen in amounts from between 0.015% to 0.031%. These nitrogen levels are generally higher than typical open hearth or basic oxygen furnace residual levels of 0.002% to 0.006% and those occurring from other steelmaking processes, and as a consequence, nitrogen is intentionally added to the steels of the invention. Nitrogen additions can be conveniently made while the steel is molten by direct addition of a nitrogen containing alloy of iron and manganese, containing about 4 to 10% nitrogen. Should other strengthening elements be present at relatively low values or strength reducing elements be present at relatively high values, vanadium and/or nitrogen should preferably be from 0.12% to 0.14% and 0.24% to 0.031%, respectively.

Aluminum must be present in amounts required to produce a killed steel. A minimum amount constitutes 0.01%. On the other hand, excessive amounts of aluminum cause a decrease in yield strength and hence, a maximum of 0.09% aluminum is utilized. Therefore, the steels of the invention are only killed to a limited portion of the total range of aluminum contents suitable for this purpose. Should strength promoting agents be at relatively low values, aluminum should be preferably maintained between 0.01% to 0.07% so as to minimize the strength reduction effect of this element.

As may be apparent from the discussion of the effect of various alloying elements upon yield strength, the virtual absence of silicon in the steel must be compensated for by a careful balance of other alloying elements so as to achieve an 80,000 p.s.i. minimum yield strength hot-rolled product. In addition, rolled product thickness and collection temperature must be controlled to routinely achieve the described strength level. All three variables must be controlled to the extent indicated by the following relationship:

$$YS \geqslant 98{,}430+182{,}310(V)+80{,}662(C)+433{,}220(N)-36.7(CT)-26{,}184(T)-92{,}543(Al), \text{ wherein,}$$

YS = Yield Strength and is 88,776 p.s.i.;
V = % Vanadium;
C = % Carbon;
N = % Nitrogen CT = Collection Temperature, °F,
T = Hot-rolled thickness, inches; and
Al = % Aluminum.

The above yield stength relationship was developed by multiple regression analysis and generated from 2791 data points. A standard deviation ($\sigma$) of 4388 p.s.i. was calculated for the relationship. Therefore, one desiring to produce routinely an 80,000 p.s.i. minimum yield strength product would need to set the yield strength portion of the relationship at 88,776 p.s.i. to achieve a 97.5% probability of obtaining the 80,000 p.s.i. Such degree of reliability constitutes a commercially usable practice and serves to define the term 80,000 p.s.i minimum yield strength for purposes of the invention. The attainment of an 80,000 p.s.i. minimum yield strength in accordance with the invention will also necessarily result in a 95,000 p.s.i. minimum ultimate tensile strength and an 18% minimum ductility as measured by elongation in 2 inches.

As may be seen from the equation, higher vanadium nitrogen, and carbon contents function to increase yield strength while higher collection temperatures, hot-rolled thickness and aluminum contents function to decrease yield strength. Therefore, it is apparent that a balance of such factors is required to produce the desired mechanical properties. Consequently, the equation provides a further constraint upon the previously described general compositional ranges. In addition, factors such as hot-rolled thickness and collection temperature influence yield strength and serve as further constraints upon the process of the invention.

The low alloy steel of the invention may be typically produced by conventional steel making process such as the basic oxygen, open hearth, electric furnace, etc. Following casting and hot rolling to slabs, the steel is hot-rolled into hot-band or plate form. The hot-rolling finishing temperature should be between the $Ar_3$ temperature of the alloy steel and about 1700°F. For the compositions and cooling rates included in the invention, 1550°F., is safely above the $Ar_3$ temperature and is considered to be a preferred minimum finishing temperature for process control purposes. Finishing temperatures below the $Ar_3$ temperature should be avoided because the austenite-ferrite transformation occurs at this temperature. Should one employ a finishing temperature below the $Ar_3$ temperature, a mixed ferritic grain structure will result because the portion of austenite that has been transformed to ferrite will be elongated with the, as yet, untransformed austenite. The untransformed austenite will subsequently transform to ferrite during cooling and collection. The later formed ferrite will be significantly smaller and relatively more equiaxed than the elongated ferrite formed prior to finish rolling. Mixed ferrite structures lead to lower toughness values in the hot rolled metallurgical conditions than the equiaxed structure obtained by the invention.

The steel of the invention is cooled at a rate of from 20°F. to 135°F. per second for previously discussed reasons. These cooling rates involve the use of water sprays or the like.

Upon secession of spray cooling, the hot-rolled product is then collected by either piling or coiling. A collection temperature of from 950°F. to 1300°F. is generally applicable to the attainment of an 80,000 p.s.i. minimum yield strength provided the other factors in the equation are sufficiently balanced. However, it is preferred to utilize collection temperatures on the low side of the general range, i.e., 950°F. to 1200°F. to further ensure the desired strength level. Collecting the product below about 950°F. is undesirable because of adverse product ductility considerations.

The favorable influence of silicon restriction upon product cleanliness is illustrated by the following data. Ingots having the chemical compositions shown in Table I were prepared and processed into hot-band.

TABLE I

| | Nominal Ingot Chemical Composition (wt%) | | | | | | | | |
|---|---|---|---|---|---|---|---|---|---|
| Trial | Thickness (In.) | Mn | P | S | Si | V | Al | N Total | Ce |
| A | .250 | 1.34 | .008 | .006 | .04 | .12 | .074 | .017 | .026 |
| B | .250 | 1.35 | .009 | .005 | .05 | .12 | .100 | .020 | .014 |
| C | .250 | 1.31 | .009 | .006 | .10 | .13 | .073 | .016 | .014 |
| D | .250 | 1.43 | .010 | .006 | .07 | .14 | .083 | .019 | .020 |
| E | .250 | 1.45 | .011 | .005 | .06 | .14 | .102 | .020 | .016 |
| F | .250 | 1.59 | .009 | .006 | .07 | .16 | .125 | .020 | .014 |
| G | .250 | 1.59 | .009 | .007 | .14 | .16 | .110 | .020 | .014 |

Following hot-rolling to hot band, tests specimens were secured and rated for cleanliness. Table II depicts the results.

TABLE II

| Trial | Inclusion Severity |
|---|---|
| A | Few scattered oxy-sulfides |
| B | Few scattered oxy-sulfides |
| C | Many oxy-sulfide chains |
| D | Clusters light to medium, mostly short oxy-sulfides |
| E | Clusters of long, medium to heavy p oxy-sulfides |
| F | Clusters of short, light oxy-sulfides |
| G | Clusters of short, light oxy-sulfides |

The cleanliness rating samples were obtained one inch from the edge of the hot-band, ground, and etched for macroinspection. Although this procedure is somewhat subjective in nature, it was apparent that trials A and B were markedly superior with respect to the lack of occurrence of oxy-sulfides than the other trials. A major distinction in macroscopic appearance was the virtual disappearance of the heavy chain-like oxy-sulfides for the trials representative of silicon contents of 0.05% and lower. The improvement represented by the lower silicon content trials is sufficient to result in improved product yield due to a reduction in edge trimming.

The beneficial results upon yield strength control indicated by the equation may be observed from the following data. Mechanical testing was performed on two samples that were hot-rolled to 0.240 inch in thickness in accordance with the invention. The data shown in Table III lists the chemical composition and collection temperature employed during thermo-mechanical processing.

TABLE III

| Trial | C | Mn | P | S | Si | V | Al | N Total | Collection Temp., °F |
|---|---|---|---|---|---|---|---|---|---|
| 1 | .12 | 1.34 | .008 | .006 | .04 | .12 | .074 | .020 | 1090 |
| 2 | .15 | 1.45 | .009 | .012 | .04 | .12 | .039 | .018 | 1060 |

The yield strength of the trial 1 hot-band ranged between 75,200 and 83,800 p.s.i. while the trial 2 hot-band yield strength ranged between 81,000 and 87,600 p.s.i. Solution of the right side of the equation yields a predicted average minimum yield strength of 85,515 p.s.i. and 91,409 p.s.i. for the trial 1 and 2 hot-band, respectively. However, such yield strength would only be achieved 50% of the time. Hence, the value corresponding to two standard deviations is a more meaningful evaluation or process reliability. Using this criteria, 2.5% of all trial 1 hot-band would have a yield strength below 76,739 p.s.i. while the corresponding yield strength for trial 2 hot-band would be 82,401 p.s.i. It is therefore believed to be apparent that further restricting the general chemical compositions and processing parameters provides a reliable technique for routinely producing an 80,000 p.s.i. minimum yield strength hot rolled vanadium-nitrogen type product containing a minimal amount of silicon. We claim:

1. A killed high strength low alloy steel product having been hot-rolled to a thickness, spray cooled, and collected immediately thereafter at temperature of from 950° to 1300°F.; having a composition consisting essentially of from 0.09% to 0.22% carbon, 1.65% maximum manganese, 0.05% maximum silicon, 0.25% maximum sulfur, from 0.015% to 0.031% nitrogen, from 0.10% to 0.14% vanadium, from 0.01% to 0.10% rare earth or rare earth mixture, 0.01% to 0.09% aluminum, balance iron; said steel composition, thickness and collection temperature also satisfying the following relationship;

$$YS \geqslant 98{,}430+182{,}310\ (V)+80{,}662\ (C)+433{,}220\ (N)\ -36.7\ (CT)-26{,}184(T)\ -92{,}543\ (Al),$$

wherein,

YS = Yield Strength and is 88,776 p.s.i.;
V = % Vanadium;
C = % Carbon;
N = % Nitrogen;
CT = Collection Temperature, °F;
T = Hot-Rolled Thickness, inches; and
Al = % Aluminum; and said steel product having an ultimate tensile strength of 95,000 p.s.i. minimum, a yield strength of 80,000 p.s.i. minimum and ductility as measured by percent elongation (2 inches) 18% minimum; and being substantially free of macroscopic rare earth oxy-sulfide inclusions.

2. The killed high strength low alloy steel product of claim 1, wherein the collection temperature ranges from 950° to 1200°F.

3. The killed high strength low alloy steel of claim 1, wherein said carbon ranges from 0.13% to 0.22%.

4. The killed high strength low alloy steel of claim 1, wherein said nitrogen ranges from 0.024% to 0.031%.

5. The killed high strength low alloy steel of claim 1, wherein said vanadium ranges from 0.12% to 0.14%.

6. The killed high strength low alloy steel of claim 1, wherein said aluminum ranges from 0.01% to 0.07%.

7. The killed high strength low alloy steel of claim 1, wherein said silicon content is 0.03% maximum.

8. A method of producing a high strength low alloy steel product, comprising:

a. hot rolling a killed steel having a composition consisting essentially of from 0.09% to 0.22% carbon, 1.65% maximum manganese, 0.05% maximum silicon, 0.025% maximum sulfur, from 0.015% to 0.31% nitrogen, from 0.10% to 0.14% vanadium, from 0.01% to 0.10% rare earth or rare earth mixture, 0.01% to 0.09% aluminum, balance iron to a thickness at a finishing temperature of above the $Ar_3$ temperature of the steel to about 1700°F., spray cooling said hot-rolled steel at a rate of from 20°F. to 135°F. per second, and collecting said hot-rolled steel at a temperature of from 950°F. to 1300°F. immediately upon termination of spray cooling so as to produce a hot-rolled product having an ultimate tensile strength of 95,000 p.s.i. minimum, a yield strength of 80,000 p.s.i. minimum, and ductility as measured by percent elongation (2 inches) of 18% minimum and substantially free of macroscopic rare earth oxy-sulfides inclusions, said steel composition, thickness and collection temperature also satisfying the following relationship:

$$YS \geq 98{,}430+182{,}310\ (V)+80{,}662\ (C)+433{,}220\ (N)-36.7(CT)-26{,}184(T)\ -92{,}543\ (Al),$$

wherein,

YS = Yield Strength and is 88,776 p.s.i.
V = % Vanadium;
C = % Carbon;
N = % Nitrogen;
CT = Collection Temperature, °F;
T = Hot-Rolled Thickness, inches; and
Al = % Aluminum.

9. The method of claim 8, wherein said collection temperature is from 950°F. to 1200°F.

* * * * *

UNITED STATES PATENT OFFICE
CERTIFICATE OF CORRECTION

Patent No. 3,982,969 Dated September 28, 1976

Inventor(s) Peter J. Koros and John David Grozier

It is certified that error appears in the above-identified patent and that said Letters Patent are hereby corrected as shown below:

Claim 8, line 7: "0.31%" should be deleted and replaced by -- .031%--; and

Claim 8, line 21: "sulfides" should be deleted and replaced by -- sulfide --.

Signed and Sealed this

Fourth Day of January 1977

[SEAL]

*Attest:*

RUTH C. MASON
*Attesting Officer*

C. MARSHALL DANN
*Commissioner of Patents and Trademarks*